US005203356A

United States Patent [19]

Yun

[11] Patent Number: 5,203,356

[45] Date of Patent: Apr. 20, 1993

[54] CIGARETTES

[76] Inventor: Myeong K. Yun, 223-3, Bukuri, Wooljinkun, Kyeongsangbukdo, Rep. of Korea

[21] Appl. No.: 711,526

[22] Filed: Jun. 10, 1991

[51] Int. Cl.[5] ..... A24D 3/00
[52] U.S. Cl. ..... 131/361
[58] Field of Search ..... 131/361, 360

[56] References Cited

U.S. PATENT DOCUMENTS 2,106,062 1/1938 Rawlings ..... 131/36
2,669,238 2/1954 Rawlings ..... 131/361

*Primary Examiner*—V. Millin
*Assistant Examiner*—J. Doyle
*Attorney, Agent, or Firm*—Jacobson, Price, Holman & Stern

[57] ABSTRACT

A cigarette has a filter and an extensible helically wound mouthpiece extending beyond the filter. The mouthpiece may itself include an additional filter element.

2 Claims, 4 Drawing Sheets

CIGARETTES

BACKGROUND OF THE INVENTION

The present invention relates to cigarettes, particularly, having a filter enclosed in a thin paper wrapper.

Since conventional cigarettes have only a filter enclosed in a thin paper wrapper at one end of the cigarettes, they are insufficient in a filtering poisonous components.

Therefore in order to give a mild flavour, it is common practice to use a cigarette holder.

It is an object of the present invention to provide cigarettes with improved filtration.

SUMMARY OF THE INVENTION

The present invention relates to cigarettes having another roll type filter paper attached to the end of the conventional filter and connected with the end of the cigarettes by the paper wrapper.

Therefore cigarettes of the instant invention are capable of effectively filtering smoke of cigarettes because it is filtered out by the original basic filter and then also by the another roll type filter paper.

BRIEF DESCRIPTION OF DRAWINGS

Referring to drawings, the present invention is described in detail as follows.

DESCRIPTION OF PREFERRED EMBODIMENTS

Figure 1:
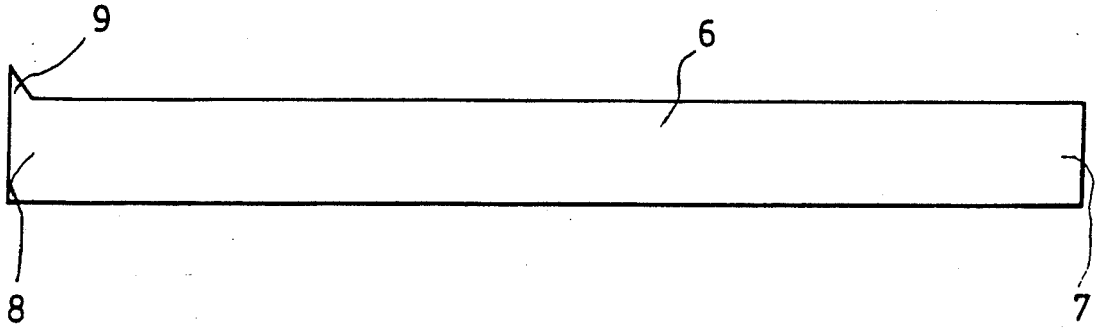
FIG. 1 is a developed view of the roll type filter paper for use in accordance with the present invention.
Figure 2:
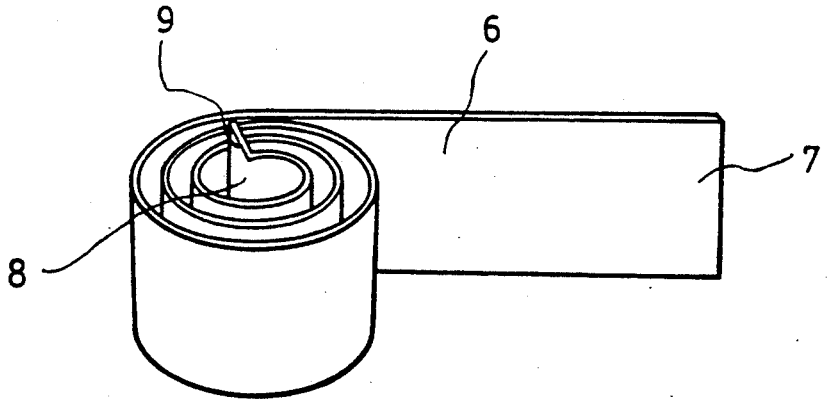
FIG. 2 is a perspective view of a roll type filter paper in accordance with the present invention.
Figure 3A:
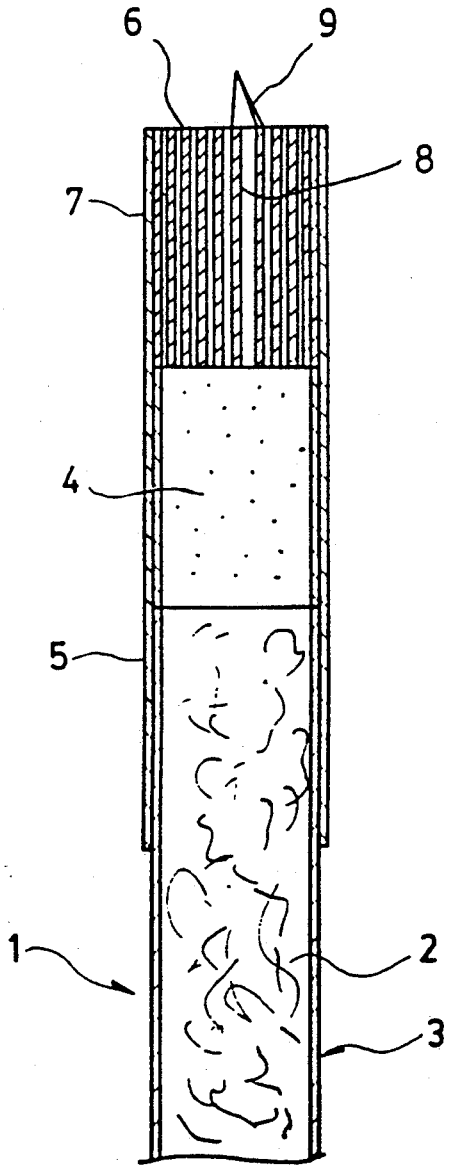
FIG. 3, (*a*) and (*b*) are cross-sectional views of cigarettes according to the present invention.
Figure 3B:
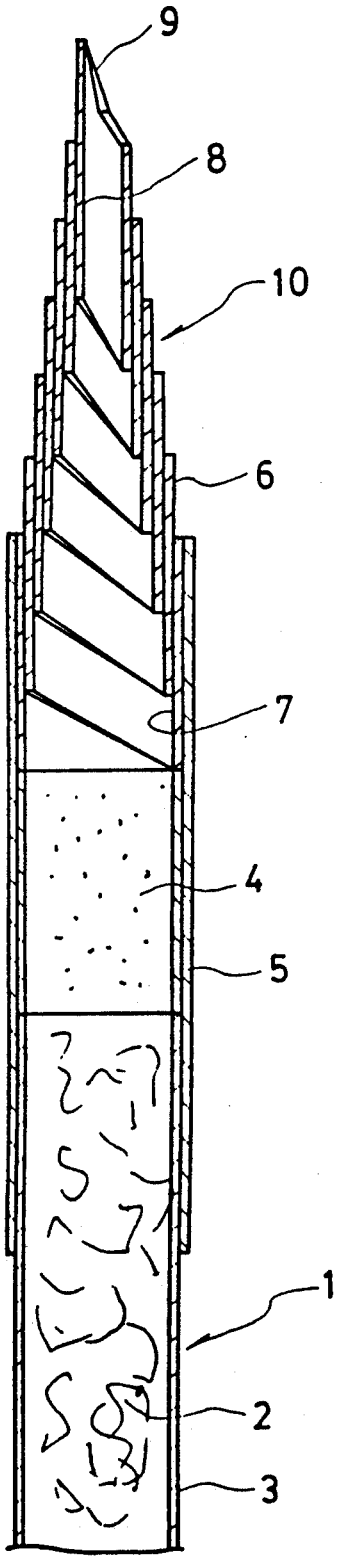

FIG. 1 through 3 represent an embodiment in accordance with the present invention.

A cigarette of the present invention is characterized by connecting an end of a cigarette (1) having tobacco (2) enclosed with a cigarette paper (3) to a basic cigarette filter (4) by a thin paper wrapper (5) in conventional manner and by connecting an another spirally wound filter paper (6) to an outer end of said cigarette filter (4) in which the filter paper (6) of appropriate density, made of more or less than 15 m/m of width of filter paper. An outer end (7) of the strip of filter paper (6) is adhered to an extended portion of the paper wrapper (5), an inner end (8) thereof is a free end not adhered to anywhere and at the inner end (8), a unitary projection tongue (9) is formed on edge of the strip project outwardly so that said filter paper (6) can be gripped and extended outwardly to form a telescopic helical mouthpiece (10) by pulling said provided tongue (9) to a cigarette holder.

The above-mentioned embodied cigarettes of the present invention are able to be packed in a conventional cigarette case as well as to be smoked as prior cigarette type, by not using the helical mouthpiece.

Therefore, it is not difficult to pack or smoke the cigarette and, it provides improved nicotine and/or removal in tobaccos by the another filter paper (6) and the prior filter (4).

Otherwise, in order to have a smoke by using the helical mouthpiece (10) if a smoker holds and then pulls outwardly the tongue (9) at the tip of the inner end (8) of the roll type filter paper (6), the roll slips outwardly, in turn, to form a helical type mouthpiece (10), wherein smoke passes through first a prior basic filter (4) and then the helical mouthpiece (10) and is cooled and contacted with an inner surface of the filter paper (6), whereby poisonous materials (components) contained in cigarette smoke can be removed substantially by a prior basic filter (4) and inner surface of filter paper (6) of the screw mouthpiece (10) to give a mild flavour.

Figure 4A:
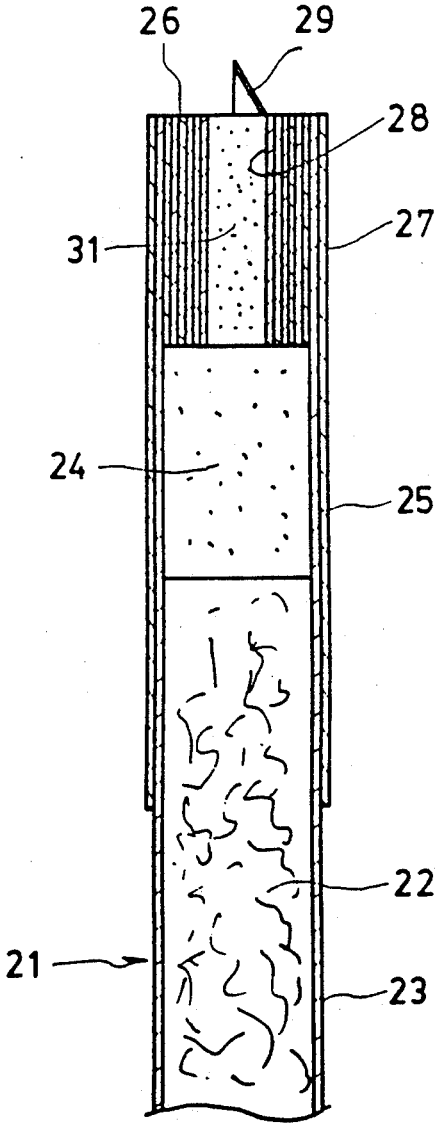
FIG. 4, (*a*) and (*b*) are cross-sectional views of modified cigarettes according to the present invention.
Figure 4B:
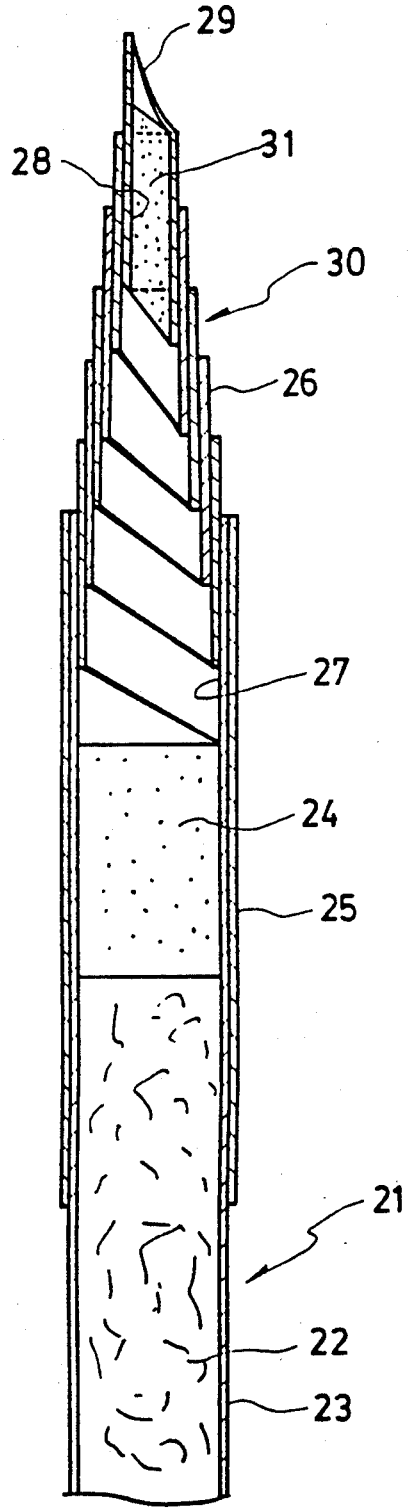
Figure 5:
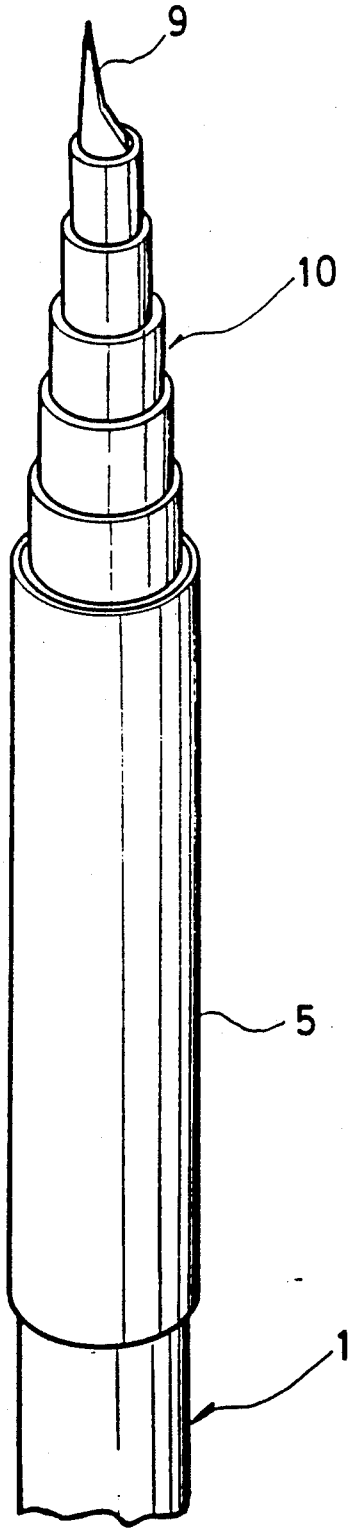
FIG. 5 is a perspective view of a cigarette with a developed roll type filter paper in accordance with the present invention.

In addition, and FIG. 4 shows another modified example of cigarettes in accordance with the present invention.

In this example, also a cigarette is characterized by connecting an end of a cigarette (21) having enclosed tobacco (22) with a cigarette paper (23) to a basic cigarette filter (24), by a thin sticking paper for filter (25) in conventional manner and then by connecting another strip of filter paper (26) wound into a roll of appropriate density to an outer end of said cigarette filter (24), wherein an outer end (27) of the filter paper (26) is adhered to the sticking paper for filter (25), an inner end (28) thereof is a free end not adhered to anywhere and at a tip of the inner end (28), a tongue (29) is formed outwardly so that said filter paper (26) be pulled out therefrom in the form of a helical mouthpiece (30) by pulling said tongue (29) to give a cigarette holder, wherein in the center of the filter paper (26) namely the inner most winding, a center filter element (31) is inserted and adhered.

The modified embodiment of the invention also has characteristics as mentioned above as well as still further filtration because it has another center filter element (31).

What is claimed is:

1. A cigarette having a filter at one end connected to the cigarette by an outer tubular paper wrapper wherein the wrapper has an extension portion projecting beyond the filter to provide a tubular receptacle, a spirally wound strip of filter paper in said receptacle having an outer end adhered to the extension portion of said wrapper and a free inner end, and said strip of filter paper having a first edge between said inner and outer ends formed with a unitary projecting tongue at said inner end of the strip of filter paper, said tongue projecting beyond the extension portion of the wrapper enabling a user to grip the inner end of the filter paper and extend same from said receptacle into a helical tubular mouthpiece.

2. A cigarette according to claim 1 wherein the strip of filter paper has an innermost winding terminating at said inner end and the cigarette further includes a filter element received in said innermost winding.

* * * * *